United States Patent [19]

Rives

[11] 4,191,255

[45] Mar. 4, 1980

[54] METHOD AND APPARATUS FOR CUTTING AND PULLING TUBULAR AND ASSOCIATED WELL EQUIPMENT SUBMERGED IN A WATER COVERED AREA

[75] Inventor: Allen K. Rives, Lafayette, La.

[73] Assignee: Lor, Inc., Houston, Tex.

[21] Appl. No.: 895,739

[22] Filed: Apr. 13, 1978

[51] Int. Cl.[2] ..... E21B 23/00; E21B 29/00; E21B 31/02

[52] U.S. Cl. ..... 166/297; 166/55.7; 166/361; 166/362; 175/207

[58] Field of Search ..... 166/361, 55.6, 55.7, 166/55.8, 297, 298, 301, 361, 362; 175/7, 209, 207

[56] References Cited

U.S. PATENT DOCUMENTS

| | | | |
|---|---|---|---|
| 2,735,485 | 2/1956 | Metcalf, Jr. | 166/55.8 |
| 3,301,324 | 1/1967 | Smith | 166/55.7 X |
| 3,338,305 | 8/1967 | Pittman et al. | 166/361 X |
| 3,376,927 | 4/1968 | Brown | 166/361 |
| 3,378,072 | 4/1968 | Smith | 166/361 X |
| 3,789,459 | 1/1974 | Murray | 166/361 |
| 3,983,936 | 10/1976 | Kennard et al. | 166/361 |
| 4,047,568 | 9/1977 | Aulenbacher | 166/55.8 X |

*Primary Examiner*—Stephen J. Novosad
*Attorney, Agent, or Firm*—Jack W. Hayden

[57] ABSTRACT

A method and apparatus for cutting and recovering tubular and associated well equipment submerged in a water covered area including the steps of lowering a well string including a cutting tool, a swivel and a releasable spear in a water covered area to seat the swivel on the well equipment to thereby position the spear above the well equipment and the cutting tool within the equipment to be cut and pulled, actuating the cutting tool to sever the well equipment, lowering the well string and then raising it sufficiently to unseat the swivel from the tubular and associated well equipment, and then lowering it again to telescope the swivel and releasable spear within the severed well equipment, and actuating the releasable spear to engage the severed well equipment for retrieval by pulling the well string out of the water covered area.

13 Claims, 11 Drawing Figures

METHOD AND APPARATUS FOR CUTTING AND PULLING TUBULAR AND ASSOCIATED WELL EQUIPMENT SUBMERGED IN A WATER COVERED AREA

BACKGROUND OF THE INVENTION

Prior art with which applicant is familiar is U.S. Pat. No. 3,983,936, and the patents cited therein. While U.S. Pat. No. 3,983,936 discloses a method of cutting submerged well equipment and retrieving it from a water covered area in one operation, such invention contemplates positioning the spear within the well equipment to be cut while such cutting operation is performed and prior to completion of the cut.

In some situations, it may be undesirable to position the spear or engaging tool within the submerged well equipment which is to be cut and retrieved before such cutting is completed. For example, in some circumstances it may be necessary to interrupt such operation and retrieve the spear to the surface of the water covered area due to weather conditions or other conditions. Also, it is desired to have a minimum amount of equipment within the tubular member and associated well equipment while it is being severed, so that if it is necessary to disengage from such tubular member and associated well equipment, such disengagement may be made rapidly, or in a manner so as to lessen the likelihood of sticking the well string within the tubular member and well equipment thereby necessitating further fishing or cutting operations.

An object of the present invention is to provide a method and apparatus for cutting and retrieving a tubular member and associated well equipment on the submerged floor of a water covered area wherein only the cutting tool is positioned in the well equipment while the cutting operation is being effected.

Yet a further object of the present invention is to provide a method and apparatus for cutting and retrieving well equipment from the submerged surface in a water covered area wherein a well string is lowered into the water covered area including a cutting tool at the lower end of the well string, a rotary swivel for resting on the well equipment while the cut is being performed, and a spear or engaging tool on the well tool in spaced relation above the swivel for subsequent positioning within the well equipment to retrieve it.

Yet a further object of the present invention is to provide a method and apparatus for cutting and retrieving well equipment from the submerged surface in a water covered area wherein a well string is lowered into the water covered area including a cutting tool at the lower end of the well string, a rotary swivel for resting on the well equipment while the cut is being performed, and a spear or engaging tool on the well tool in spaced relation above the swivel and wherein the swivel is constructed and arranged so that it may be collapsed to enable it to be lowered into the well equipment along with the spear thereabove after the cut has been performed whereby the spear may be engaged with the severed well equipment for retrieving it to the surface of the submerged water covered area along with the well string.

Other objects and advantages of the present invention will become more readily apparent from a consideration of the following description and drawings.

DESCRIPTION OF THE PREFERRED EMBODIMENT

Figure 1:
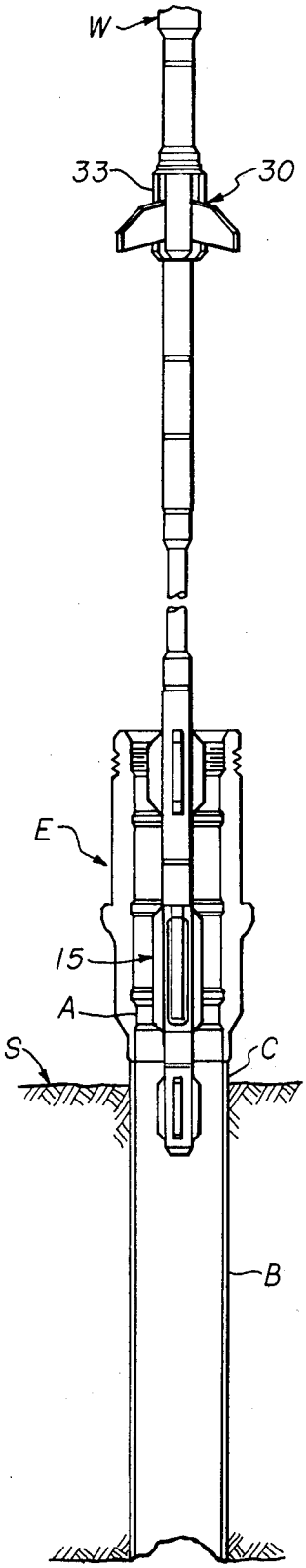
FIG. 1 is a diagrammatic, partial sectional view illustrating well equipment including a tubular member in a submerged surface of a water covered area and showing the present invention being lowered thereinto.

In FIG. 1 the submerged surface in a water covered area is referred to generally by the letter S. As the well bore B is drilled in the submerged surface S, a tubular casing illustrated at C and associated well equipment referred to generally by the letter E is shown as extending upwardly above the submerged surface S in the water covered area. After drilling operations have been completed, it is generally desirable to remove the portion of the tubular member C and well equipment E extending upwardly above the submerged surface S to inhibit any problems that might otherwise be associated with leaving such equipment projecting above the submerged surface S.

A well string designated generally by the letter W is lowered into the water covered area from a drilling vessel or platform and includes cutter means referred to generally by the numeral 15, a swivel referred to generally by the numeral 30 and a spear referred to generally by the numeral 40. It will be noted that, as shown in the drawings, the cutter means 15 is adjacent the lower end of the well string W, while the swivel 30 is spaced above the cutter means 15 and the spear 40 is positioned in spaced relation above the swivel 30.

In FIG. 1 the well string W is shown as being lowered into the well equipment E including the tubular member C while in FIG. 2 the well string W is shown in the position it will assume after the cut on the well equipment E has been completed and the well string lowered to actuate the swivel to enable the swivel 30 and spear 40 to be subsequently lowered into the well equipment E whereby the spear 40 may be engaged with the severed well equipment E for retrieval to the surface in the water covered area.

Figure 3:
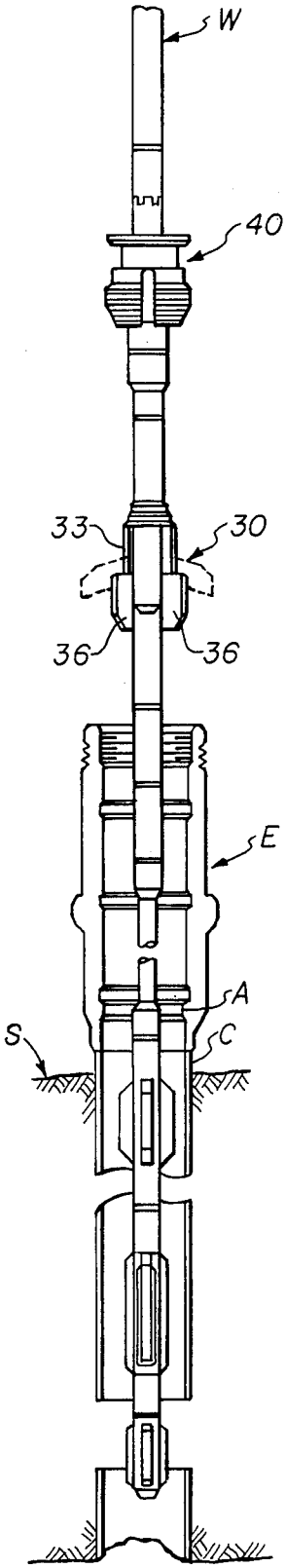
FIG. 3 is a view similar to FIG. 2 showing the relationship of the components of the swivel after it has been actuated to effect collapsing of a portion thereof to enable such swivel and the spear thereabove to be lowered into the severed well equipment for engagement and retrieval to the surface of the submerged area.
Figure 4:
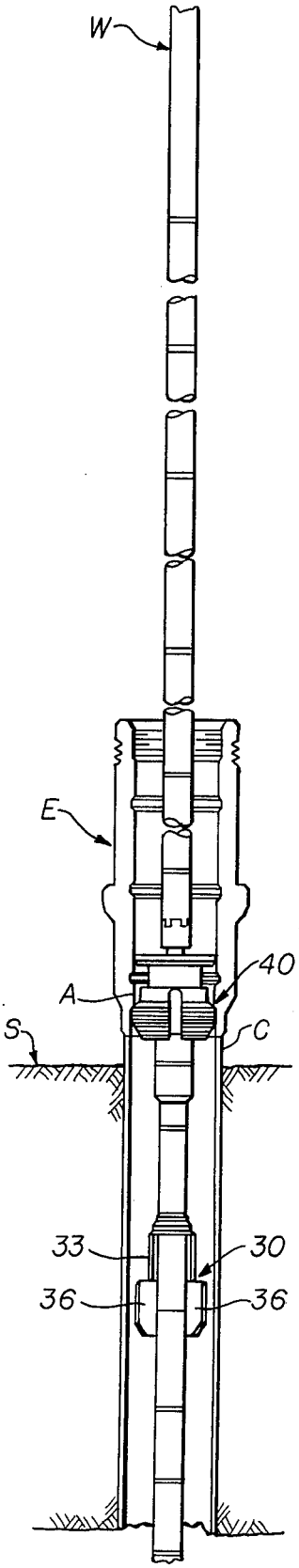
FIG. 4 is a view similar to FIGS. 1—3 and showing the spear engaged with the well equipment for retrieval thereof.

FIG. 3 shows the position of the well string W after the swivel 30 has been actuated to enable it to assume a position so that the well string W with the swivel 30 and the spear 40 may be moved into the well equipment E to assume the position illustrated in FIG. 4 of the drawings to engage the spear 40 with the severed well equipment.

Figure 5:
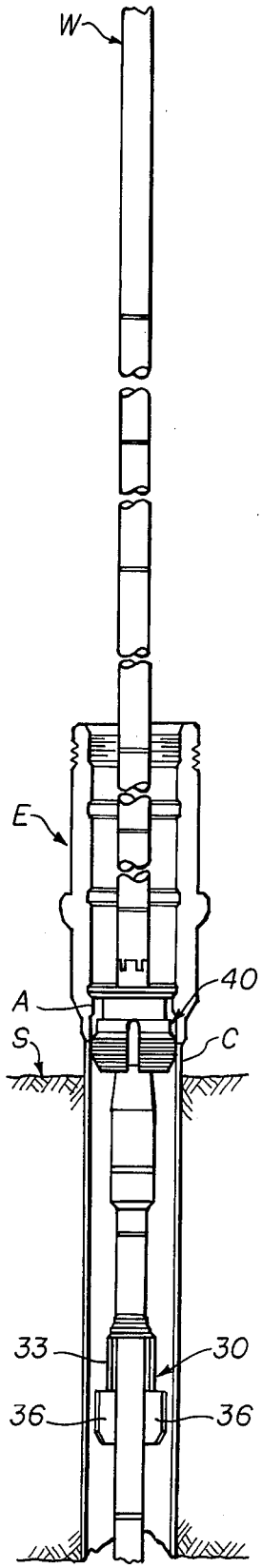
FIG. 5 is a view similar to FIG. 4 showing the spear within, but disengaged from the well equipment.
Figure 6:
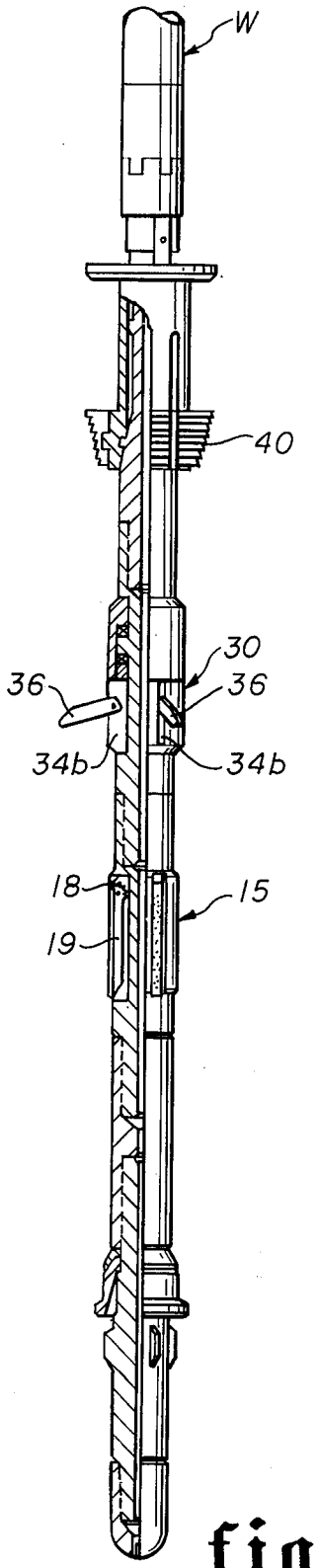
FIG. 6 is a sectional view partly in elevation showing a well string with a cutter, swivel and spear carried thereby.

FIG. 5 illustrates the position of the well string W and the spear 40 in relation to the well equipment E if, for any reason, it is desired to disengage the spear from the well equipment and retrieve the well string W to the surface of the water without retrieving the well equipment E.

Figure 7:
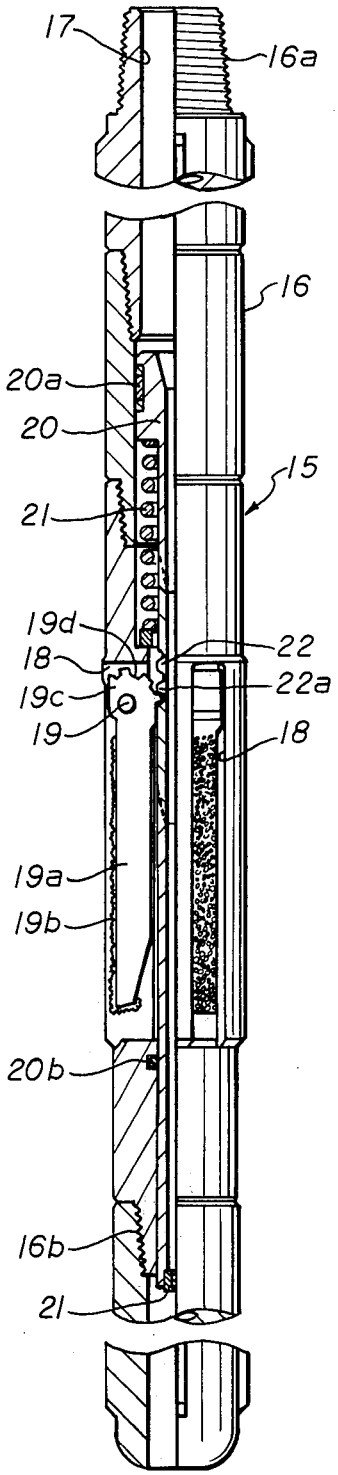
FIG. 7 is an enlarged sectional view illustrating the details of a form of hydraulically actuated cutter which may be used with the present invention.

FIGS. 6—11 illustrate further structural details of the cutter means 15, swivel 30 and spear 40 connected in the well string W to accomplish the objects of the present invention. The cutter means 15 as shown in FIG. 7 includes elongated hollow tubular body 16 having the bore 17 therethrough. The body 16 is provided with threaded ends 16*a* and 16*b* for engagement within the well string W. A plurality of circumferentially spaced, longitudinally extending slots 18 are formed in the body 16 as illustrated in the drawings. Pivotally mounted at 19 within the slots 18 is a cutter arm or body 19*a* which extends longitudinally of each slot 18 as shown and may be provided with any suitable cutting surface such as illustrated at 19*b* for engaging and cutting the tubular member C and well equipment E associated therewith. As shown, the cutter means 15 is of the hydraulically actuated type and to this end a longitudinally extending tubular member 20 is arranged in the bore 17 and supported therein by the spring 21 to accommodate movement of the tubular member 20 within the bore 17 relative to the body 16 of the cutter means 15.

Seals 20*a* and 20*b* sealably engage between the elongated tubular member 20 and the bore 17 as shown. The lower end of the tubular member 20 is provided with an orifice or restriction 21 so that discharge of fluid from the bore 17 into the hollow elongated tubular member 20 and through the orifice 21 in the lower end is retarded. Thus, when hydrostatic pressure is applied in the well string W above the cutter means 15, the orifice 21 restricts discharge of fluid from member thereby causing the tubular member 20 to move downwardly. The longitudinally extending member 20 includes gear teeth 22 which extend longitudinally on the outer periphery of the member 20 as shown to form a gear rack 22*a*. The end 19*c* of the pivotally mounted cutter blade 19*a* is provided with gear teeth 19*d* which mate with the gear rack 22*a* as shown. It can be appreciated that each cutter blade 19 is provided with such gear teeth 19, and a gear rack 22*a* is provided on the elongated member 20 adjacent each of the cutter blades 19*a* to engage therewith. In operation of the cutter means 15, the hydrostatic pressure in well string W is increased and this causes member 20 to move downwardly against the force of spring 21. Movement of rack 22*a* causes the cutter blades 19*a* to pivot outwardly and engage with the casing C below the surface S. Thereupon rotation of the well string W may be effected at the surface and such rotation continued while the hydrostatic pressure is maintained to continue to urge the cutter blades 19*a* outwardly to effect cutting of the tubular member C and associated well equipment E as illustrated at 25 in FIG. 2. When the cut is completed, the hydrostatic pressure in the well string W is relieved which relieves the pressure in the bore 17 and the spring 21 returns the tubular member 20 to the position illustrated in FIG. 7. As this occurs the pinion 19*d* and gear rack 22*a* cooperate to retract the cutter blades 19*a* to the position shown in FIG. 7 of the drawings.

Figure 8:
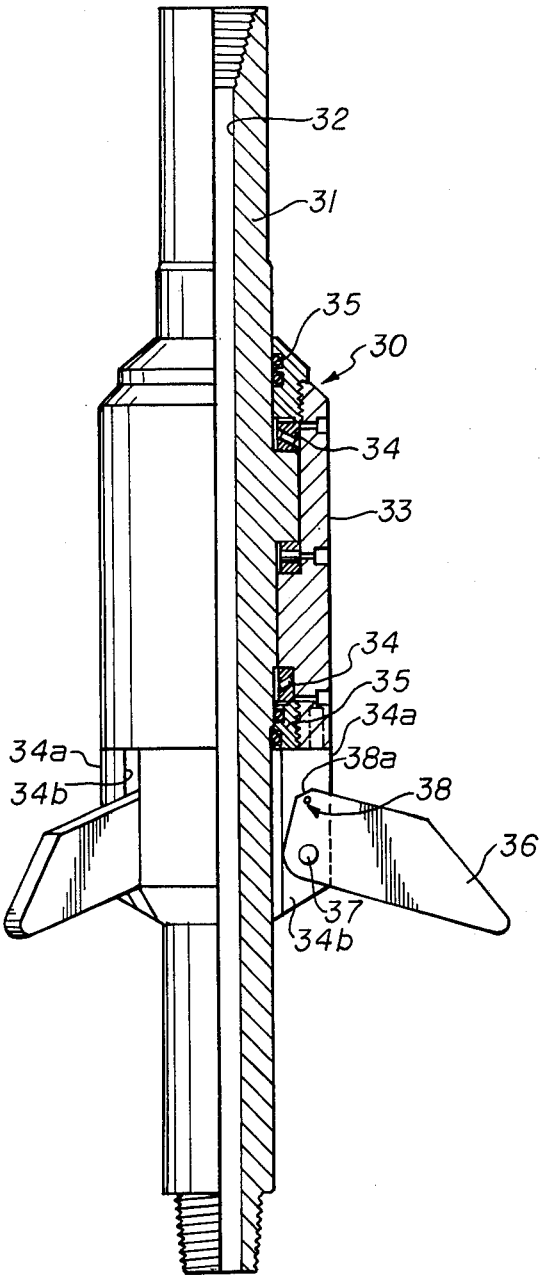
FIG. 8 is a quarter sectional view illustrating the details of the preferred form of swivel employed with the present invention and showing the position assumed by the support means to seat on the well equipment while the present invention is actuated to sever the well equipment.
Figure 9:
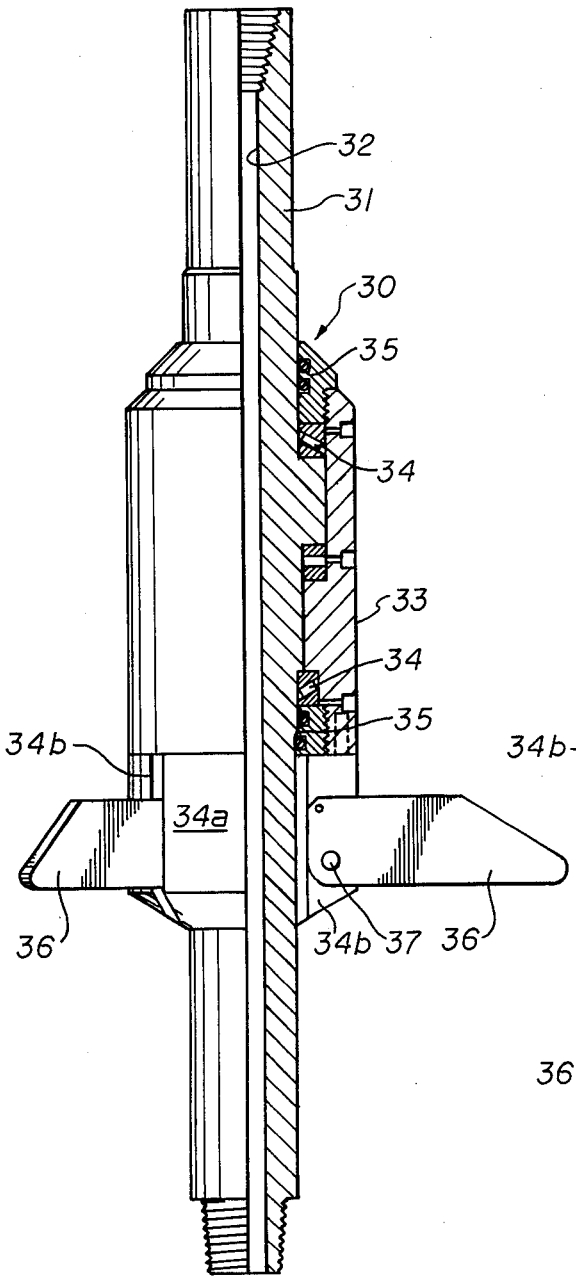
FIG. 9 is a sectional view similar to FIG. 8 but showing the position of the support means when the well string is lowered while the support means is seated on the well equipment to effect deactivation or retraction of such support means.
Figure 10:
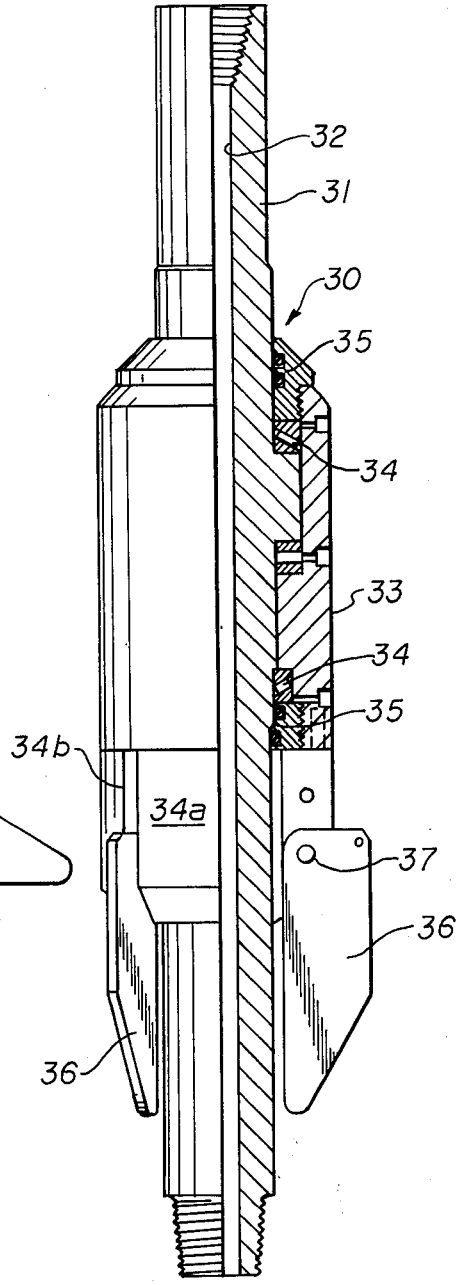
FIG. 10 is a sectional view similar to FIG. 9 showing the support means in deactivated or retracted position so that the swivel and the spear thereabove may be lowered into the severed well equipment for engagement by such spear.
Figure 11:
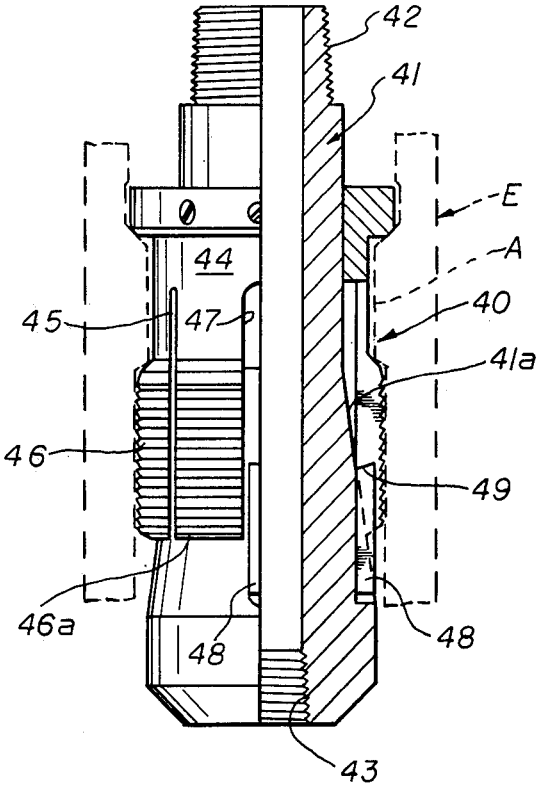
FIG. 11 is a quarter sectional view illustrating a form of spear which may be employed with the present invention.

The swivel 30 associated with the well string W to perform the method of the present invention is illustrated in FIGS. 8 thru 10 and is shown as including a tubular mandrel or body 31 having a longitudinal bore 32 therethrough. An outer housing 33 is rotatably and sealably carried on the mandrel 32 by the bearings 34 and the seals 35, respectively, whereby the mandrel 32 and well string W may be rotated relative to the housing 33. The seals 35 protect the bearings 34 in the subsea environment. The lower end of the outer housing 33 includes an annular, downwardly depending skirt 34*a* in which slots 34*b* are formed as shown. Such slots are circumferentially spaced and extend from a position beneath the lowermost seal 35 to the lower end of the outer housing 33 as shown in the drawings. Supports means 36 in the form of plate like members are pivotally mounted as shown at 37 in each of the slots 34*b* and are adapted to seat on the upper end 14 of the well equipment as illustrated in FIG. 2 of the drawings.

The support means 36 is maintained in a position for seating on the upper end of the well equipment W, such position being as illustrated in FIG. 8 of the drawings. The support means 36 is maintained in such position by the release means referred to generally at 38. Such release means is preferably in the form of a shear pin 38*a* which extends through the support means 36 within the slots 34*b* and into skirt 34*a*.

Figure 2:
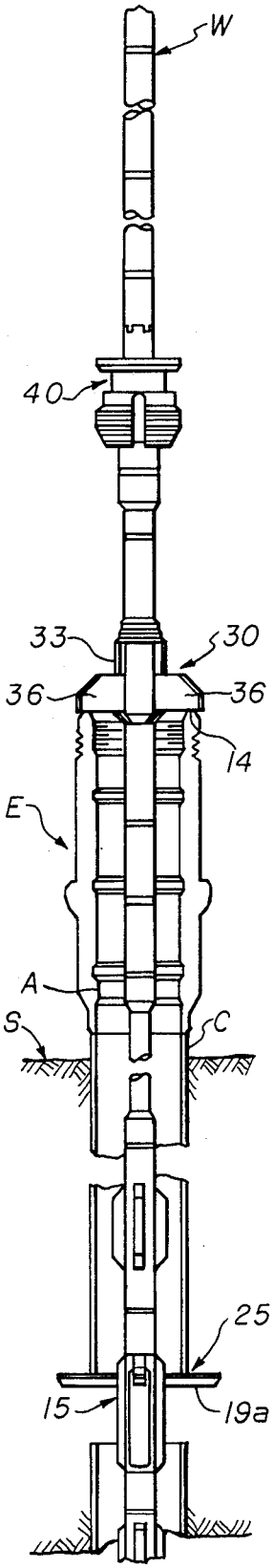
FIG. 2 is a view similar to FIG. 1 showing the present invention with the swivel seated on the upper end of the well equipment and with the cutter in position after cutting of the well equipment has been effected.

After the cutter means 15 has been actuated to perform the cut on the well equipment E as illustrated at 25 in FIG. 2, it is then desirable to lower the well string W so as to engage the spear 40 with the severed portion and retrieve it to the surface of the water along with the well string W. To accomplish this the well string W is lowered so as to set weight on the support means 36 of the swivel 30 in an amount sufficent to shear the pins 38*a*. When the pins 38*a* are sheared, the support means 36 are then ready to assume a configuration relative to the remainder of the swivel 30 as shown in FIGS. 2 and 10 of the drawings. The well string W is then elevated so the support means 36 can pivot downwardly to assume the relationship shown in FIGS. 3—5, and 10 of the drawings to enable the swivel 30 and the spear 40 thereabove to be telescoped within the well equipment E as shown in FIGS. 4 and 5 of the drawings.

The spear 40 includes the mandrel 41 having threads 42 and 43 for engagement within the well string W. An annular, outwardly tapered portion 41*a* is formed on mandrel 41 as shown, and longitudinally extending stops 48 extend outwardly from the surface 41*a* at circumferentially spaced points as shown.

An outer tubular member or housing 44 is slidably carried on the mandrel 41 as shown in the drawings.

Such outer housing 44 includes longitudinally extending slots 45 with circumferentially extending slip segments 46 formed between the slots 45 as shown.

Additional longitudinal slots 47 are provided at circumferentially spaced positions on housing 44 as shown in the drawings to receive the stops 48 when it is desired to actuate the spear 40 to engage well equipment W.

When the mandrel 41 and the outer member 44 are in the position as illustrated with the stops 48 positioned in the slots 47, an upward force to cause upward movement of the well string W will urge the slip segments 46 to ride outwardly on the annular surface 41*a* of the mandrel 41 and thereby engage with the well equipment E immediately beneath the annular flange A formed internally thereof.

The upper end 49 of the stops 48 are tapered as shown and the spear 40 is initially positioned in the well string W so that the tapered upper end 49 of the stop 48 engage the lower tapered ends 46*a* of the slip segments 46 to inhibit outward movement thereof. However, after cutting of the well equipment E by the cutter means 15 as described, and after the swivel 30 and spear 40 have been lowered into the severed well equipment, the well string may be rotated to release the stops 48 from the ends 46*a* and align them with the slots 47 so that subsequent outward movement of the slip segments 46 may occur as described.

If, for any reason, it should be desired to disengage the spear 40 from the severed well equipment E, the well string W may be lowered and then rotated to disengage the stops 48 from slots 47, whereupon the slip segments may spring inwardly over the annular inwardly extending projection A as the well string W is pulled or retrieved to the earth's surface.

From the foregoing, it can be seen that the present invention provides a method and arrangement wherein only the cutter means on the well string W is positioned within the well equipment E and tubular member C as a cut is being performed. Thus, should some emergency arise requiring disengagement or discontinuing of such operations, the cutter blades 19*a* may be readily retracted and disengaged and the well string W moved out of the well equipment E to the surface. However, in the prior art where the spear 40 is within the well equipment E during the cutting operation, such spear may actuate improperly, or may inhibit release of the well string W from the well equipement E if, for some reason, it is desired to terminate or interrupt the cutting operations.

The foregoing disclosure and description of the invention are illustrative and explanatory thereof, and various changes in the size, shape, and materials as well as in the details of the illustrated construction may be made without departing from the spirit of the invention.

What is claimed is:

1. A method of cutting and pulling tubular and associated well equipment submerged in a water covered area comprising the steps of:

a. lowering a well string including a cutting tool, a swivel and releasable spear in the water covered area to seat the swivel on the well equipment to thereby position the spear above the well equipment and the cutting tool within the well equipment to be cut and pulled;

b. actuating the cutting tool to sever the well equipment;

c. actuating the swivel to unseat it from the well equipment and lowering the well string to position the swivel and releasable spear within the severed well equipment; and d. actuating the releasable spear to engage the severed well equipment for retrieval by first rotating and then pulling the well string out of the water covered area.

2. The method of claim 1 wherein the swivel includes release means which unseats the swivel from the well equipment by the steps of:

a. first lowering the well string while the swivel is seated on the well equipment to actuate the release means; and b. raising the well string whereupon the release means enables the swivel to assume a configuration for telescoping it and the spear thereabove within the well equipment as the well string is lowered.

3. The method of claim 1 wherein the cutting tool is actuated by pumping fluid into the well string and rotating the well string to sever the well equipment.

4. A method of cutting submerged tubular and associated well equipment and pulling it from a water covered area in a single trip comprising the steps of:

a. lowering a well string into the water covered area to seat a swivel in the well string on the well equipment for positioning a cutting tool in the well string within the well equipment to be cut while maintaining a spear in the well string in spaced relation above the well equipment whereby the well string may be readily removed from the well equipment during the cutting thereof if desired;

b. pumping fluid into the well string and rotating the well string to actuate the cutting tool for severing the well equipment;

c. lowering and then raising the well string sufficiently to unseat the swivel from the well equipment and to engage the spear within the severed well equipment; and d. pulling the well string from the water covered area along with the severed well equipment.

5. The method of claim 4 wherein the swivel includes release means which unseats the swivel from the well equipment by the steps of:

a. first lowering the well string while the swivel is seated on the well equipment to actuate the release means; and b. raising the well string whereupon the release means enables the swivel to assume a configuration for telescoping it and the spear thereabove within the well equipment as the well string is lowered.

6. An arrangement for connection in a well string to be lowered in a water covered area for cutting and retrieving submerged tubular and associated well equipment in a one step operation comprising:

a. a cutting tool secured adjacent the lower portion of the well string for engaging and cutting the well equipment upon rotation of the well string;

b. a releasable spear in the well string for engaging the cut well equipment for retrieving it when the well string is pulled from the water covered area; and c. a swivel in the well string including seat means to seat said swivel on the well equipment to position said cutting tool within the well equipment for cutting thereof while maintaining said spear in spaced relation above said swivel and well equipment as said cutting tool is actuated.

7. The invention of claim 6 including release means for said swivel seat means operable upon predetermined downward movement of the well string when said seat means is engaged with the well equipment to enable said seat means to retract when the well string is thereafter raised, whereupon said swivel and spear may be lowered into the well equipment by the well string.

8. In a well string wherein a cutting tool is carried to engage and cut submerged tubular and associated well equipment in a water covered area and a spear is carried for securing to the cut well equipment for retrieval along with the well string when it is raised to the surface, the invention comprising:

a. swivel means adapted to be carried by the well string to accommodate relative rotation between said swivel means and the well string;

b. support means on said swivel means for engaging the well equipment to support the cutting tool within the well equipment as it is cut while maintaining the spear in spaced relation above the well equipment as the cutting tool is actuated to cut the submerged well equipment; and c. release means associated with said support means operable upon lowering the well string a predetermined amount while said support means is engaged with the well equipment to enable said support means to retract when the well string is thereafter raised whereby the well string may then be lowered to move said swivel and spear into the cut well equipment to engage the spear with the well equipment for pulling it out of the water covered area with the well string.

9. The invention of claim 8 wherein said support means includes members pivotally mounted on and extending outwardly from said swivel to seat on the well equipment and wherein said release means includes shear means which shear upon lowering the well string a predetermined amount.

10. A swivel for use in a well string for conducting subsea operations on well equipment including:

a. an elongated hollow mandrel for connection in the well string;

b. an outer member rotatably supported on said mandrel;

c. circumferentially spaced support means extending outwardly of said outer member for seating on said well equipment while conducting the operations; and d. release means associated with said support means operable upon lowering the well string a predetermined amount while said support means is engaged with the well equipment to enable said support means to retract when the well string is thereafter raised whereby the well string may then be lowered to move the swivel into the well equipment.

11. The invention of claim 10 wherein seal means are provided between said mandrel and outer member to seal off the rotatable support between said mandrel and housing.

12. The invention of claim 10 wherein said circumferentially spaced support means extends radially relative to the end of the well equipment on which is seated said support means.

13. In a well string wherein a cutting tool is carried to engage and cut submerged tubular and associated well equipment in a water covered area and a spear is carried for securing to the cut well equipment for retrieval along with the well string when it is raised to the surface, the invention comprising:

a. swivel means adapted to be carried by the well string to accomodate relative rotation between said swivel means and the well string;

b. support means on said swivel means for engaging the well equipment to support the cutting tool within the well equipment as it is cut while maintaining the spear in spaced relation above the well equipment as the cutting tool is actuated to cut the submerged well equipment; and c. release means associated with said support means, said release means being constructed and arranged upon predetermined movement of the well string to release said support means from the well equipment whereby said swivel and the cutting tool may be telescoped within the cut well equipment to engage the spear with the well equipment for pulling it out of the water covered area with the well string.

* * * * *